United States Patent [19]

Iacono

[11] 4,045,113

[45] Aug. 30, 1977

[54] CONNECTOR SAFETY TIP

[75] Inventor: Frederick Della Iacono, Crestwood, N.Y.

[73] Assignee: Kings Electronics Company, Inc., Tuckahoe, N.Y.

[21] Appl. No.: 700,381

[22] Filed: June 28, 1976

[51] Int. Cl.[2] ..... H01R 13/52

[52] U.S. Cl. ..... 339/111; 174/5 R; 200/149 A; 339/46; 339/143 R

[58] Field of Search ..... 339/111, 46, 143 R, 339/DIG. 3; 200/151, 149 A; 174/5 R

[56] References Cited

U.S. PATENT DOCUMENTS 3,140,374 7/1964 Cole ..... 200/151 X

*Primary Examiner*—Roy Lake
*Assistant Examiner*—DeWalden W. Jones
*Attorney, Agent, or Firm*—Bierman & Bierman

[57] ABSTRACT

A safety tip for a connector contact of the type having a conductive body surrounding the contact is provided. The tip is made of an insulating material, preferably plastic.

6 Claims, 2 Drawing Figures

CONNECTOR SAFETY TIP

This invention relates to connectors and more particularly to connectors of the type containing a male contact. Connectors of this type include cable connectors, plugs, adapters, receptacles and generally all types of units which are useful in either connecting a cable or any line for carrying electric current to any other like line or other device.

The male conductor, in assemblies that may be connected to an operating electric energy source, can frequently prove dangerous. Human hands touching a live male contact, where the body is grounded, will conduct. If the source is sufficiently powerful, unintended harm to personnel may result.

Connectors adapted to handle coaxial cable having an outer conductive sheath for grounding or shielding are particularly dangerous. In this type of connector, a ground contact often surrounds or is placed adjacent to the male conductor. Even the most careful of personnel will accidentally insert a finger into the connector. In most conventional connectors, contact will be made with both the male conductor and the ground contact. The danger to personnel handling the connector, should it be live, is readily apparent.

In accordance with this invention, an insulating tip is placed over the forward or exposed end of the male conductor. In connectors of the coaxial type, the insulating tip can effectively prevent finger contact between the male conductor and the ground contact.

Figure 1:
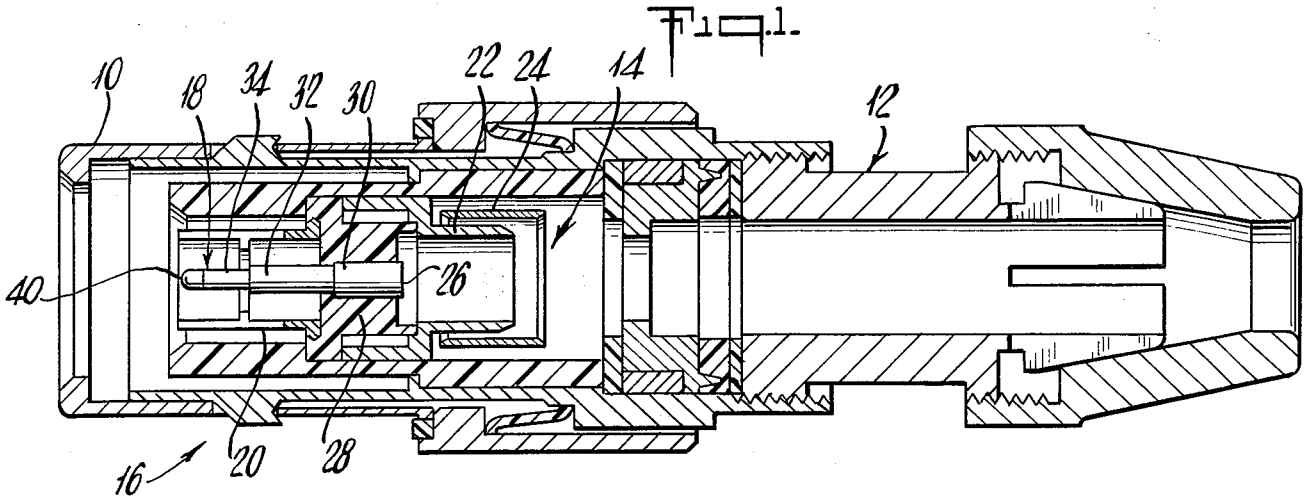
FIG. 1 is a sectional view of a connector embodying the invention.

In the drawings the numeral 10 denotes the outer body of a typical plug type connector having a rear section 12 with a female section 14.

Female section 14 receives a cable in conventional manner. Male section 16 is located opposite female section 14 and includes a male center conductor 18 surrounded by a grounding contact 20, which in turn is connected to the receiving body 22 and sleeve 24 in the female section of the connector. The cable (not shown) has a center conductor which is inserted in the rear 26 of male center conductor 18. Insulating gasket 28 serves to both space the ground contact from the male center conductor and prevent shorting between them.

Figure 2:
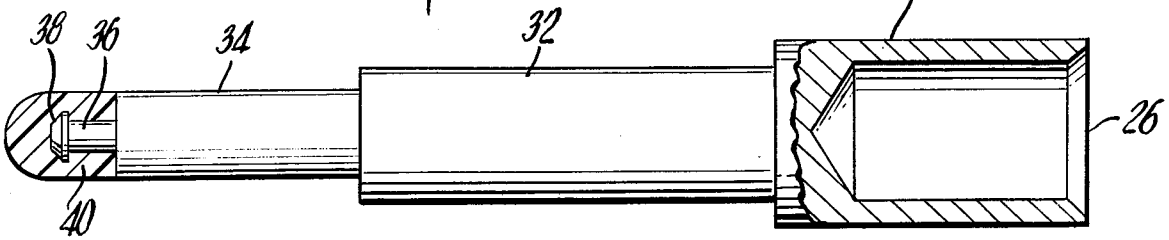
FIG. 2 is a detail of the male center conductor of FIG. 1.

The male center conductor shown in the drawings is provided with four sections, the largest being denoted by the numeral 30; the next, which is somewhat smaller in thickness or diameter being denoted by the numeral 32; the third section, which is again smaller in thickness or diameter being denoted by the numeral 34; and the last and smallest being denoted by the numeral 36 (FIG. 2). As shown in FIG. 2, section 36 ends in a truncated cone 38 which is in turn covered by insulating tip 40. Although four sections are shown for the male center conductor, more or less than four can be used if desired.

The particular insulating tip shown in FIGS. 1 and 2 covers the entire fourth section 36. The tip shown has a basically cylindrical body terminating in a spherical head. Of course, the tip need not be made according to this geometry but may be tapered instead. The only requirement is that the cable be able to make contact with some portion of the male center conductor.

It can be readily appreciated that a finger inserted into the male end of the connector can and likely will make contact with the center conductor —all too often with the ground contact as well. The insulating tip acts to prevent finger contact between the male center conductor and the ground contact. Further, most connectors of this type will have a portion of the connector body 10 extending forward of the male center conductor. This also helps to prevent insertion of fingers into the space between the male center conductor and grounding contact.

Many modifications may be made in and to the above-described embodiments by those skilled in the art. It is intended to cover all such modifications which fall within the spirit and scope of the invention as defined in the claims appended hereto.

What is claimed is:

1. A connector having a male center conductor, a grounding contact surrounding said male center conductor and spaced therefrom and not contacting said male center conductor, an insulating tip on the end of said male center conductor for reducing the chance of finger contact between the male center conductor and the grounding contact.

2. The connector according to claim 1 wherein said connector has a body surrounding said grounding contact and extending past the tipped end of said male center conductor.

3. The connector according to claim 1 wherein said insulating tip is made of plastic.

4. The connector according to claim 1 wherein said insulating tip is made of glass.

5. The connector according to claim 1 wherein said insulating tip is made of ceramic material.

6. The connector according to claim 1 wherein said male center conductor has a reduced thickness section and wherein said tip is mounted on said reduced thickness section.

* * * * *